US005971601A

United States Patent [19]

Kozyuk

[11] Patent Number: 5,971,601

[45] Date of Patent: Oct. 26, 1999

[54] METHOD AND APPARATUS OF PRODUCING LIQUID DISPERSE SYSTEMS

[76] Inventor: Oleg Vyacheslavovich Kozyuk, 14600 Brookpark Rd., Cleveland, Ohio 44135

[21] Appl. No.: 09/019,823

[22] Filed: Feb. 6, 1998

[51] Int. Cl.[6] ..... B01F 5/06

[52] U.S. Cl. ..... 366/176.1; 366/340; 138/40

[58] Field of Search ..... 366/176.1, 176.2, 366/181.5, 336, 338, 340; 138/37, 40, 42, 43, 46

[56] References Cited

U.S. PATENT DOCUMENTS

| | | | |
|---|---|---|---|
| 513,318 | 1/1894 | Grimm . | |
| 830,338 | 9/1906 | Ledoux . | |
| 1,627,161 | 5/1927 | Edwards . | |
| 1,892,906 | 1/1933 | Schnitter . | |
| 2,132,854 | 10/1938 | Knott | 366/176.1 |
| 2,548,759 | 4/1951 | Allen . | |
| 2,882,025 | 4/1959 | Loo | 366/340 |
| 3,049,574 | 8/1962 | Johnson . | |
| 3,081,257 | 3/1963 | Johnson et al. . | |
| 3,170,863 | 2/1965 | Spillane et al. . | |
| 3,467,072 | 9/1969 | Toesca . | |
| 3,744,762 | 7/1973 | Schlicht | 366/340 |
| 3,834,982 | 9/1974 | Alexandrovich et al. . | |
| 3,937,445 | 2/1976 | Agosta . | |
| 3,942,765 | 3/1976 | Henrickson . | |
| 3,988,329 | 10/1976 | Zucker . | |
| 4,000,086 | 12/1976 | Stoev et al. | 366/176.1 |
| 4,081,863 | 3/1978 | Rees | 366/340 |
| 4,124,309 | 11/1978 | Yao | 366/340 |
| 4,127,332 | 11/1978 | Thiruvengadam et al. | 366/176.1 |
| 4,145,520 | 3/1979 | Feltgen et al. . | |
| 4,164,375 | 8/1979 | Allen | 366/337 |
| 4,316,673 | 2/1982 | Speer | 366/337 |
| 4,344,752 | 8/1982 | Gallagher, Jr. . | |
| 4,354,762 | 10/1982 | Cantoni | 366/340 |
| 4,464,057 | 8/1984 | Darrieu et al. | 366/139 |
| 4,498,786 | 2/1985 | Ruscheweyh | 366/336 |
| 4,506,991 | 3/1985 | Hudson | 366/341 |
| 4,674,888 | 6/1987 | Carlson | 366/337 |
| 4,832,500 | 5/1989 | Brunold et al. | 138/37 |
| 4,893,275 | 1/1990 | Tanaka et al. . | |
| 4,915,135 | 4/1990 | Kellenbarger et al. | 138/44 |
| 4,929,088 | 5/1990 | Smith | 366/337 |
| 5,030,789 | 7/1991 | Dang Vu et al. . | |
| 5,085,058 | 2/1992 | Aaron et al. . | |
| 5,145,256 | 9/1992 | Wiemers et al. | 366/336 |
| 5,179,297 | 1/1993 | Hsueh et al. . | |
| 5,264,645 | 11/1993 | Hugues et al. . | |
| 5,300,216 | 4/1994 | Hertzberg et al. . | |
| 5,341,848 | 8/1994 | Laws | 138/44 |
| 5,413,145 | 5/1995 | Rhyne et al. | 138/44 |
| 5,492,654 | 2/1996 | Kozjuk et al. . | |
| 5,495,872 | 3/1996 | Gallagher et al. | 138/44 |
| 5,810,052 | 9/1998 | Kozyuk | 138/40 |

FOREIGN PATENT DOCUMENTS 48921 12/1990 European Pat. Off. .

*Primary Examiner*—Charles E. Cooley
*Attorney, Agent, or Firm*—Emerson & Associates; Roger D. Emerson; Timothy D. Bennett

[57] ABSTRACT

A method and apparatus for producing a liquid disperse system in a flow-through channel is described. The flow-through channel has first and second chambers. The liquid in the first chamber is maintained at a steady pressure $P_1$. The liquid is passed through a localized flow constriction creating cavitation liquid jets that flow into the second chamber. The dynamic pressure of the liquid jets is govern by the equation $\rho v^2/2 \geqq 0.15\ P_1$ where $\rho$ is the density of the cavitation liquid jet and $v$ is the velocity of the cavitation jet. Cavitation bubbles are produced in the cavitation liquid jets between $1\times10^{-6}$ m and $1\times10^{-2}$ m. The pressure in the second chamber $P_2$ is maintained such that $P_1/P_2$ is $\leqq 9.8$. The liquid disperse system is produced by the collapsing of cavitation bubbles under static pressure $P_2$ in the second chamber. The pressure $P_2$ in the second chamber is maintained by a localized resistance at an outlet of the second chamber. The localized flow constriction may be shaped to produce cavitation liquid jets which are cylindrical, ring-shaped, or flat-shaped. The liquid flow may be passed through the flow-through channel a number of times to further increase the production of liquid disperse systems.

11 Claims, 1 Drawing Sheet

METHOD AND APPARATUS OF PRODUCING LIQUID DISPERSE SYSTEMS

BACKGROUND OF THE INVENTION

1. Field of Invention

This invention relates to the method of producing liquid disperse systems with the aid of hydrodynamic cavitation. This method may find application in chemical, petroleum, food, cosmetic, pharmaceutical and other branches of industry.

2. Description of the Related Art

At the present time, there are many known methods of producing liquid disperse systems, in particular, suspensions and emulsions, using the effect of hydrodynamic cavitation. In these methods, the emulsification and dispersion processes go on as a result of cavitation influences purposely created in the processing flow by the hydrodynamic course as a result of the passage of the flow through a localized constriction of the flow. The mixing, emulsifying and dispersing influences of hydrodynamic cavitation occur as a result of a great number of powerful influences on the processed components under the collapsing cavitation bubbles.

Known is the issued patent entitled Process and apparatus for obtaining the emulsification of nonmiscible liquids, U.S. Pat. No. 3,937,445 issued Feb. 10, 1976 to V. Agosta, comprising a decrease in the static pressure in the liquid as a result of the passage of it through a constricted Venturi channel, to the pressure of saturated vapors of the liquid and the creation of oscillating cavitation bubbles.

The described method does not provide a high effectiveness of emulsification, in so far as the intensity of the rise of pulsating field of cavitating bubbles is low. The energy which is emitted by the pulsations of a cavitation bubble is always lower than the energy emitted by the collapse of a cavitation bubble. Furthermore, in this case method, uncontrolled cavitation is used that results in the bubbles being distributed in the large volume of the liquid medium. This leads to a decrease in the level of energy dissipation in the mass unit of the medium and does not allow production of thin emulsions.

In another known patent entitled Method of obtaining free disperse system and device for effecting same, U.S. Pat. No. 5,492,654 issued Feb. 20, 1996 to O. Kozjuk et al, which comprises the passage of hydrodynamic flow through a flow-through channel with a baffle body positioned inside of it providing a localized construction of the flow and creation of a cavitation field downstream of it.

Such a method is sufficiently effective for emulsification processes. However, the use of it for homogenization processes when rather finely dispersed emulsions are required during a single pass of components through the device is significantly difficult, and at times not possible. This is associated with the fact that a significant part of the flow energy goes to the generation of the primary cavity, which thereafter tears away from the baffle body and breaks up on the bubbles. The bubbles collapse in the primary cavity disintegration zone where the static pressure in the surrounding liquid appears to be low. At the same time, the static pressure of the surrounding liquid bubbles appears as the main parameter which determines the level of energy emitted during collapse of cavitation bubble. The higher the magnitude of the static pressure, the better the result of cavitation dispersion.

Thus, there continues to exist a requirement for a method which may lead to improved emulsification, dispersion, and homogenization in a more effective way.

The present invention involving the method of producing liquid disperse systems allows creation of optimal regimes of cavitation dispersions as a result of maintenance of the most effective limits of the main parameters of the collapsing bubbles cavitation field. These parameters are related to the sizes of the bubbles, their concentration in the flow and the static pressure in the surrounding liquid bubbles at the moment of their collapse. Given these parameters, it is possible to create controlled cavitation, possessing the most effective technological regimes for dispersion.

The present invention contemplates a new and improved apparatus and method for producing liquid disperse systems with the aid of hydrodynamic cavitation which is simple in design, effective in use, and overcomes the foregoing difficulties and others while providing better and more advantageous overall results.

SUMMARY OF THE INVENTION

In accordance with the present invention, a new and improved apparatus and method for producing liquid disperse systems with the aid of hydrodynamic cavitation is provided which overcomes the foregoing difficulties and others while providing better and more advantageous overall results.

More particularly, in accordance with the present invention, a method of producing liquid disperse systems in a flow-through channel is disclosed. The flow-through channel has a first chamber and a second chamber. The method includes the steps of passing a liquid flow containing dispersed components through the first chamber, thereby maintaining a first static pressure $P_1$. The method further includes the step of forming a cavitation liquid jet in a localized flow constriction as the liquid flow passes from the first chamber to the second chamber. The cavitation liquid jet has a density p of the dispersed components and a velocity v. The cavitation liquid jet further has a dynamic pressure governed by the equation $\rho v^2/2 \geqq 0.15\ P_1$, whereby cavitation bubbles are produced in the cavitation liquid jet between $1\times10^{-6}$ m and $1\times10^{-2}$ m. The method further includes the steps of introducing the cavitation liquid jets into the second chamber. The second chamber maintains a second static pressure $P_2$ such that $P_1/P_2$ is $\leqq 9.8$. The method further includes the steps of collapsing the cavitation bubbles under the second static pressure $P_2$, and producing liquid disperse systems by collapsing the cavitation bubbles.

According to another aspect of the invention, a flow-through channel apparatus for producing liquid disperse systems from a liquid flow containing dispersed components is described. A flow-through channel apparatus includes a first chamber for containing passage of the liquid flow. The liquid flow is maintained in the first chamber at a first static pressure $P_1$. The flow-through channel also includes a second chamber for containing passage of the liquid flow adjacent to the first chamber. The liquid flow is maintained in the second chamber at a second static pressure $P_2$. The flow-through channel also includes a localized flow constriction located between the first chamber and the second chamber. The localized flow constriction forms a cavitation liquid jet having a density $\rho$ of dispersed components, a velocity v, and a dynamic pressure such that the cavitation liquid jet is govern by the equation $\rho v^2/2 \geqq 0.15\ P_1$. The cavitation bubbles are produced in the cavitation liquid jet between $1\times10^{-6}$ m and $1\times10^{-2}$ m.

The object of the present invention is to introduce an improvement in emulsification, dispersion and homogenization.

More practical, the purpose of the present invention is the implementation of the improved method of producing liquid disperse systems.

The other objective of the present invention is the utilization of hydrodynamic cavitation in an optimal regime for improving dispersion processes of liquid mediums. The above introduced, and many other, purposes of the present invention, are satisfied by the process in which the liquid flow of dispersed components, located under static pressure $P_1$, in the first chamber are fed through the localized flow constriction into the second chamber, located under static pressure $P_2$. During this, cavitation liquid jets are formed in the localized flow constriction, having a dynamic pressure of $\rho v^2/2 \geqq 0.15\ P_1$ and maintaining the sizes of the cavitation bubbles and cavities from $1\times10^{-6}$ m to $1\times10^{-2}$ m. Here, $\rho$ is the density of the disperse medium and $v$ is the velocity of the cavitation jet. The cavitation jet is introduced into the second chamber, in which the static pressure $P_2$ is maintained within the limit of $P_1/P_2 \leqq 9.8$. Under the influence of the given static pressure $P_2$ cavitation bubbles and cavities collapse in the second chamber, rendering a dispersing influence on the processed components. The cavitation liquid jet may have a cylindrical, ring-shaped or flat-shaped form. Moreover, in the second chamber, located under static pressure $P_2$ it is possible to introduce one, two or more independent cavitation jets.

The static pressure $P_2$ in the second chamber is maintained due to the placement of an additional localized restriction at the outlet from this chamber or at some distance. The localized hydraulic resistance may be non-adjustable or adjustable depending on the designation of the process.

In some cases, a recirculating flow of dispersed components is expediently utilized through the localized flow constriction for producing a narrower distribution of dispersion particle sizes.

Still other benefits and advantages of the invention will become apparent to those skilled in the art to which it pertains upon a reading and an understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and herein.

For a better understanding of the invention, the specific examples cited below of its implementation with references to the enclosed drawings are represented.

DESCRIPTION OF THE PREFERRED EMBODIMENT

Figure 1:
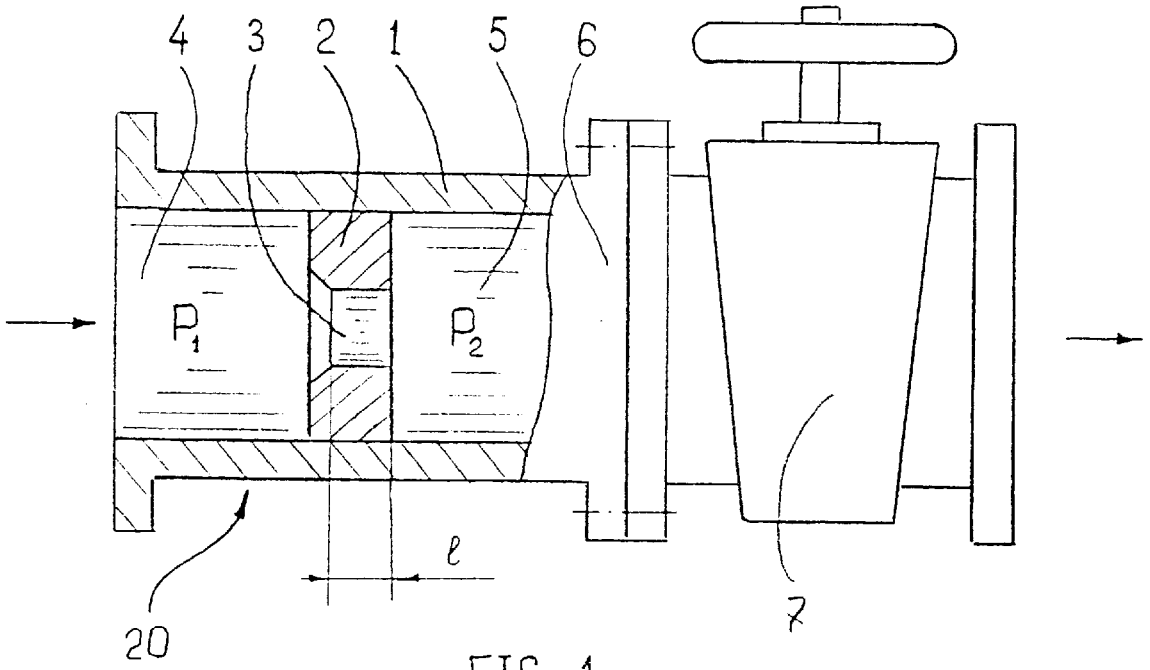
FIG. 1 is a schematic illustration of the longitudinal section of the apparatus for implementation of the presented method, maintaining the localized flow constriction in which a cylindrical cavitation liquid jet and adjustable localized hydraulic resistance is formed.

Referring now to the drawings which are for purposes of illustrating a preferred embodiment of the invention only and not for purposes of limiting the same, FIG. 1 shows the longitudinal view of apparatus 20, which is comprised of flow-through channel 1 containing localized flow constriction 2 inside of it. Localized flow constriction 2 is fulfilled in the form of a diaphragm with one cylindrical orifice 3. Orifice 3 may be cylindrical, oval or right-angled. Depending on the shape of the orifice, this determines the shape of cavitation jets flowing from localized flow constriction 2. Furthermore, there may be two or more orifices 3 in localized flow constriction 2 of various shapes.

Localized flow constriction 2 divides flow-through channel 1 into two chambers: first chamber 4 and second chamber 5. First chamber 4 is positioned to localized flow constriction 2, and second chamber 5 after localized flow constriction 2 if it is viewed in the direction of movement of the flow. At outlet 6 from second chamber 5, additional localized hydraulic resistance 7 is positioned which allows to maintain in second chamber the required static pressure $P_2$. In the given case, additional localized hydraulic resistance 7 is adjustable. For this, it may be possible to use a faucet or gate valve.

The liquid flow of dispersed components is fed with the aid of an auxiliary pump under static pressure $P_1$ into first chamber 4 of the apparatus. Further, the flow passes through orifice 3 in localized flow constriction 2 and enters into second chamber 5 having static pressure $P_2$. The sizes of orifice 3 as well as its shape are selected in such a manner, in order for the liquid jet dynamic pressure formed in orifice 3 to be maintained, emanating from the integer $$\rho v^2/2 \geqq 0.15\ P_1$$

where $\rho$ is the density of the disperse medium, and $v$ is the velocity of the cavitation jet flowing from orifice 3. Under these conditions, hydrodynamic cavitation arises in the liquid jets in the form of intermingling cavitation bubbles and separate cavitation cavities. The length L in orifice 3 in localized flow constriction 2 is selected in such a manner in order that the residence time of the cavitation bubble in orifice 3 not exceed $1\times10^{-3}$ seconds.

The given dynamic pressure and residence time of the bubble in the localized flow constriction 2 allows production of cavitation bubbles and cavities in the liquid jet in sizes from $1\times10^{-6}$ m to $1\times10^{-2}$ m and with concentration levels of $1\times10^{9}$ to $1\times10^{11}$ $1/m^3$. A large portion of cavitation bubbles have sizes in the range of $1\times10^{-5}$ m to $5\times10^{-4}$ m and cavitation cavities from $8\times10^{-4}$ m to $5\times10^{-3}$ m. Moreover, their sizes are dependent on the magnitude of the dynamic pressure jet as well as the sizes of orifice 3 in the localized flow constriction 2. Increase of the dynamic pressure jet as well as size of orifice 3 leads to the increase in the sizes of cavitation bubbles. Increase of the dynamic pressure of the cavitation jet also promotes increase of the concentration of cavitation bubbles. Therefore, given the dynamic pressure of the cavitation jet, its shape, and the number of jets, it is possible to produce a cavitation field of cavitation bubbles and their required concentration and sizes.

Cavitation bubbles and cavities together with the liquid jets enter into the second chamber 5, where they collapse under the influence of static pressure $P_2$. The energy emitted during collapse of cavitation bubbles is directly proportional to the magnitude of the static pressure in the surrounding liquid bubbles. Therefore, the greater the magnitude of $P_2$ the greater the energy emitted during collapse of cavitation bubbles and the better the dispersion effect. As shown in the experiments, maintaining pressure $P_2$ from the integer $P_1/P_2 \leqq 9.8$ appears to be the most optimal for dispersion processes.

Failure to carry out the given integer, for example, the work of the apparatus in the regime of $P_1/P_2>9.8$ leads to creating a supercavitation flow after the localized flow constriction, which appears to be ineffective for fulfilling the dispersion process. Under supercavitation flows, a greater portion of the energy flow goes to maintaining supercavities attached to the flow body and ultimately is consumed by the heated mediums.

Maintaining pressure $P_2$ in second chamber 5 from the integer $P_1/P_2 \leqq 9.8$ also promotes the condition for the bubbles to collapse in a sufficiently compact jet zone after the localized flow constriction 2. Therefore, the level of energy dissipation in the mass unit of the medium will be great in comparison with the supercavitation flow regimes. Moreover, by increasing the magnitude of $P_2$, we increase the "severity" or "hardness" of collapse of each cavitation bubble separately, as well as the level of energy dissipation due to the decrease of the volume in which these bubbles collapse. Therefore, if the dynamic pressure of the jet answers for the quantity and sizes of bubbles, then static pressure $P_2$ determines the portion of energy which these bubbles consume on the dispersion process. And, the level of energy dissipation from the collapsing cavitation bubbles may attain a magnitude in the order of $1\times10^{15}$ watts/kilogram and greater. These levels of energy dissipation allow production of submicron emulsions.

The magnitude of static pressure $P_2$ in second chamber 5 is maintained due to the location of the additional localized restriction 7 at the outlet from this chamber. The additional localized restriction may be adjustable or non-adjustable. By utilizing the adjustable additional localized resistance 7 it is possible to control the "severity" or "hardness" of cavitation influence and in the same process, the cavitation dispersion. Such adjustment is more expedient in apparatuses that are intended for dispersing various mediums. Non-adjustable localized additional hydraulic resistance is more expedient in apparatuses intended for dispersing similar components. In the character of adjustable additional localized resistance, it may be possible to use devices such as a gate valve, faucets and other similar devices. In the character of non-adjustable, there may be various orifices, diaphragms, grates, etc. or technological devices located beyond the dispersing apparatus, for example, filters, heat exchangers, pumps, separators, other mixers, and so forth.

It may be possible to feed one, two or more independent cavitation jets into second chamber 5 located under static pressure $P_2$. Two or more cavitation jets may be established in one localized flow constriction 2 as well as in several localized flow constrictions. Moreover, two or more cavitation jets may be fed into second chamber 5 under various angles to one another.

Figure 2:
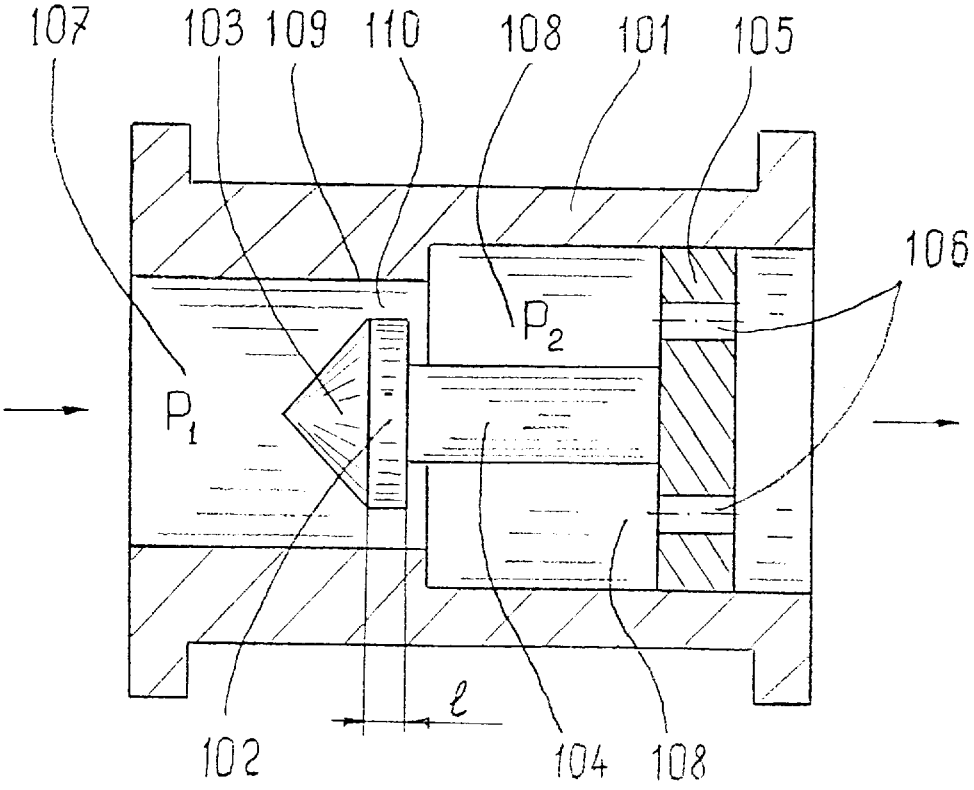
FIG. 2 is a schematic illustration of the longitudinal section of the apparatus for implementation of the presented method, maintaining the localized flow constriction in which a ring-shaped cavitation liquid jet and non-adjustable localized hydraulic resistance is formed.

FIG. 2 presents an alternative apparatus design intended for the implementation of the method.

The given apparatus allows creation of a ring-shaped cavitation liquid jet. In the given apparatus, localized flow constriction 102 is mounted inside flow-through channel 101. Localized flow constriction 102, due to its placement inside flow-through channel 101 along its baffle body centerline, has a cone form 103. Baffle body 103 is secured on rod 104, which is connected with disc 105, containing holes 106 through its body. Localized flow constriction 102 divides flow-through channel 101 into two chambers: first chamber 107 and second chamber 108, consecutively positioned along the flow stream. Disc 105, held by baffle body 103, is mounted at the outlet from second chamber 108. Simultaneously, disc 105 fulfills the function of the non-adjustable additional localized hydraulic resistance. Its magnitude will depend on the sizes of hole 106 and disc 105, their quantity, and also on the liquid flow rate and its physical properties. Baffle body 103 with wall 109 of flow-through channel 101 forms ring gap 110 in which ring-shaped cavitation liquid jets are generated.

The liquid flow of dispersed components is fed with an auxiliary pump under static pressure $P_1$ into first chamber 107 of the apparatus Further, the flow passes through ring gap 110 in localized flow constriction 102 and enters into second chamber 108 having static pressure $P_2$. The sizes of ring gap 110 and also the shape of baffle body 103 are selected in such a manner so that the dynamic pressure of the liquid jet formed in ring gap 110 is maintained, emanating from the integer where $\rho$ is the density of the disperse medium, $v$ is the velocity of the cavitation jet flowing from baffle body 103.

$$\rho v^2/2 \geqq 0.15\ P_1$$

The magnitude of pressure $P_2$ in second chamber 108 is maintained, emanating from the integer $P_1/P_2 \leqq 9.8$ due to the selection of sizes and number of holes 106 in disc 105. Cavitation bubbles and cavities formed in the ring-shaped cavitation jet exiting from ring gap 110 collapse under the influence of pressure $P_2$. This gives optimal value of the magnitude of static pressure $P_2$ in the second chamber allowing effecting utilization of the energy emitted from the collapsing cavitation bubbles on the dispersion processes. The diameters of first chamber 107 and second chamber 108 may be equal. However, in order to eliminate the cavitation erosion of the walls of flow-through channel 101, it is preferred that first chamber 107 has a smaller diameter as shown in FIG. 2. The shape of the chamber is not essential for influencing the dispersion process. The cylindrical shape is more technologically suited from the standpoint of its manufacture.

The baffle body may also have various shapes: conical, spherical, disc, elliptical or have a combination shape.

The processed components may repeatedly pass through the apparatus shown on FIGS. 1 and 2.

Some practical examples of the accomplishment of the method with the aid of the apparatus shown in FIGS. 1 and 2 are described below in Table 1. The results presented in Examples 1 and 2 of Table 1 were produced with the aid of the apparatus shown on FIG. 1. The results presented in Examples 3, 4, 5, 6 of Table 1 were produced with the aid of the apparatus shown on FIG. 2.

TABLE 1

| No. | Disperse System | Number of Passes | $P_1$ psi | $P_2$ psi | $\rho v^2/2$ psi | $P_1/P_2$ | $\rho v^2/2 \div P_1$ | Before Processing $d_{32}$ microns | After Processing $d_{32}$ microns |
|---|---|---|---|---|---|---|---|---|---|
| 1 | 60% silicone oil in water + surfactants | 5 | 800 | 100 | 672 | 8.0 | 0.840 | 70.21 | 0.62 |

TABLE 1-continued

| No. | Disperse System | Number of Passes | $P_1$ psi | $P_2$ psi | $\rho v^2/2$ psi | $P_1/P_2$ | $\rho v^2/2 \div P_1$ | Before Processing $d_{32}$ microns | After Processing $d_{32}$ microns |
|---|---|---|---|---|---|---|---|---|---|
| 2 | 4% $Fe_3O_4$ in water | 4 | 500 | 70 | 450 | 7.1 | 0.900 | 4.36 | 3.22 |
| 3 | 2% vegetable oil in water without surfactants | 1 | 88 | 54 | 17.4 | 1.63 | 0.197 | — | 4.57 |
| 4 | 2% vegetable oil in water without surfactants | 1 | 79 | 24 | 35 | 3.3 | 0.443 | — | 2.89 |
| 5 | 2% vegetable oil in water without surfactants | 1 | 910 | 140 | 683 | 6.5 | 0.75 | — | 0.96 |
| 6 | 3.8 % fat in raw milk | 1 | 1140 | 180 | 729 | 6.3 | 0.64 | 1.30 | 0.47 |

The quality of the disperse system prior to processing and after processing were evaluated according to their Sauter mean diameter value or the $d_{32}$ size of emulsion drops or suspension particles.

It should now be apparent that there has been provided, in accordance with the present invention, a novel process for producing liquid disperse systems which substantially satisfies the objects and advantages set forth above. Moreover, it will be apparent to those skilled in the art that many modifications, variations, substitutions and equivalents for the features described above may be effected without departing from the spirit and scope of the invention. Accordingly, it is expressly intended that all such modifications, variations, substitutions and equivalents which fall within the spirit and scope of the invention as defined in the appended claims to be embraced thereby.

The preferred embodiments have been described, herein. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. A method of producing liquid disperse systems in a flow-through channel having a first chamber and a second chamber, said method comprising the steps of:

passing a liquid flow containing dispersed components through said first chamber, thereby maintaining a first static pressure $P_1$;

forming a cavitation liquid jet in a localized flow constriction as said liquid flow passes from said first chamber to said second chamber, said cavitation liquid jet having a density $\rho$ of said dispersed components and velocity $v$, said cavitation liquid jet further having a dynamic pressure governed by the equation $\rho v^2/2 \geqq 0.15\ P_1$ whereby cavitation bubbles are produced in said cavitation liquid jet between $1\times10^{-6}$ m and $1\times10^{-2}$ m;

introducing said cavitation liquid jet into said second chamber, said second chamber maintaining a second static pressure $P_2$ such that $P_1/P_2 \leqq 9.8$;

collapsing said cavitation bubbles under said second static pressure $P_2$; and, producing liquid disperse systems by said collapsing cavitation bubbles.

2. The method of claim 1 further comprising the step of:

maintaining said second static pressure $P_2$ in said second chamber by locating a localized resistance at an outlet of said second chamber.

3. The method of claim 1 further comprising the step of:

repeatedly passing said liquid flow containing said dispersed components through said flow-though channel.

4. A flow-through channel apparatus for producing liquid disperse systems from a liquid flow containing dispersed components, comprising:

a first chamber for containing passage of said liquid flow, said liquid flow being maintained in said first chamber at a first static pressure $P_1$;

a second chamber for containing passage of said liquid flow adjacent to said first chamber, said liquid flow being maintained in said second chamber at a second static pressure $P_2$; and, a localized flow constriction located between said first chamber and said second chamber, said localized flow constriction forming a cavitation liquid jet having a density $\rho$ of dispersed components, a velocity $v$, and a dynamic pressure such that the cavitation liquid jet is governed by the equation $\rho v^2/2 \geqq 0.15\ P_1$, and whereby cavitation bubbles are produced in said cavitation liquid jet between $1\times10^{-6}$ m and $1\times10^{-2}$ m.

5. The apparatus of claim 4 wherein:

said second static pressure $P_2$ is maintained in said second chamber such that $P_1/P_2 \leqq 9.8$.

6. The apparatus of claim 5 further comprising:

a localized resistance located at an outlet of said second chamber for maintaining said second static pressure $P_2$ in said second chamber.

7. The apparatus of claim 6 wherein said localized resistance is adjustable.

8. The apparatus of claim 6 wherein said localized resistance is fixed.

9. The apparatus of claim 6 wherein said localized flow constriction is shaped such that said cavitation liquid jet has a cylindrical shape.

10. The apparatus of claim 6 wherein said localized flow constriction is shaped such that said cavitation liquid jet has a ring-shaped form.

11. The apparatus of claim 4 further comprising:

a second localized flow constriction located between said first chamber and said second chamber, said second localized flow constriction forming a second cavitation liquid jet.

* * * * *